United States Patent [19]

Becker et al.

[11] 4,342,635

[45] Aug. 3, 1982

[54] ANODE CASE FOR A GALVANIC BATH

[75] Inventors: Joahann Becker, Langenhagen; Hermann Koop, Gehrden; Hans Schüeddekopf, Hanover, all of Fed. Rep. of Germany

[73] Assignee: Polygram GmbH, Hamburg, Fed. Rep. of Germany

[21] Appl. No.: 238,139

[22] Filed: Feb. 25, 1981

[30] Foreign Application Priority Data

Mar. 18, 1980 [DE] Fed. Rep. of Germany ..... 3010383

[51] Int. Cl.[3] ..... C25C 7/02; C25C 7/04; C25D 17/04; C25D 17/12

[52] U.S. Cl. ..... 204/263; 204/283; 204/287; 204/297 R

[58] Field of Search ..... 204/283, 297 R, 252, 204/287, 297 R; 204/5, 275, 263

[56] References Cited

U.S. PATENT DOCUMENTS

| | | | |
|---|---|---|---|
| 969,921 | 9/1910 | Thum | 204/283 X |
| 2,250,937 | 7/1941 | Thompson | 204/252 |
| 3,186,932 | 6/1965 | Gelfand et al. | 204/5 X |
| 4,187,154 | 2/1980 | Dewallens | 204/5 |
| 4,269,669 | 5/1981 | Soby et al. | 204/5 |

FOREIGN PATENT DOCUMENTS

| | | | |
|---|---|---|---|
| 2336849 | 4/1975 | Fed. Rep. of Germany . | |
| 1503553 | 10/1967 | France | 204/5 |
| 984535 | 2/1965 | United Kingdom | 204/287 |
| 1423488 | 2/1976 | United Kingdom | 204/5 |

OTHER PUBLICATIONS

Article entitled "Galvanisieren mit hoher Abscheidungs-geschwindigkeit", Metalloberfläche 32 (1978) 9, pp. 377–381 (Translation included) .

*Primary Examiner*—Donald R. Valentine

*Attorney, Agent, or Firm*—Hill, Van Santen, Steadman, Chiara & Simpson

[57] ABSTRACT

An anode case is immersed within a deposition cell of a galvanic bath and is supported on an electrically conducting guide or support bar arrangement via a perforated contact plate which extends over the entire length of the anode case and is welded on in the vicinity of the feed opening of the anode case. The anode case is also covered by an anode enclosure which is not permeable to an anode slurry. The enclosure is slid into position in the vicinity of the contact plate in the slot between the contact plate and the anode case.

5 Claims, 3 Drawing Figures

ANODE CASE FOR A GALVANIC BATH

BACKGROUND OF THE INVENTION

The invention concerns an anode case which is supported in good electrically conducting contact on an electrically conducting guide or support bar arrangement within a deposition cell of a galvanic bath, and which is supplied via a feed opening at the upper narrow or short side with deposition material, for example, pellets.

For the insertion, removal or refilling of the anode case, it has been proven to be practical to simply place the anode case onto a guide or support bar arrangement within the deposition cell. The weight of the anode case and the anode material contained in it suffices to produce a good-conducting electrical contact between the guide or support bar arrangement and the anode case, so that even in the case of high currents, as are used in the case of a quick galvanization, overheating at the transition points because of transition resistances which are too large, and thus a disintegration of the electrolytes, or even a destruction of the anode case, is avoided.

In order to obtain smooth pitless and poreless galvanic deposits, care must be taken that the anode slurry which forms during the dissolving of the anode material does not reach the cathode. As practical experience has demonstrated, it does not suffice to cover the anode case with a filter cloth on the front side of the anode case arranged opposite the workpiece to be galvanized and which represents the cathode.

SUMMARY OF THE INVENTION

It is an object of the invention to provide a further solution for an anode case which rests on a guide or support bar arrangement. This solution must have low cost and prevent a cross-over of the anode slurry to the cathode in a reliable manner while simultaneously guaranteeing a sufficiently low transit resistance between the anode case and the support bar arrangement required for a quick galvanization.

This object is achieved according to the invention since on the anode case on the side of the support bar arrangement, specifically in the vicinity of the feed opening, a perforated contact plate is fastened in a manner which conducts well electrically, and which extends at a predetermined small spacing over the entire length of the anode case and beyond the lower narrow side. The anode case is enveloped or surrounded with an anode bag or enclosure which is impermeable with respect to the anode slurry in such a manner that the anode is located on the side of the contact plate between the contact plate and the anode case.

By means of the inventive design of the anode case with a perforated contact plate, it becomes possible in an extraordinarily advantageous manner to draw an anode slurry filter over the anode case in the form of an anode enclosure without the electrically high-conducting contact between the anode case and the support bar arrangement being thereby influenced.

Basically, there is the possibility of equipping the inner wall of the anode case with a filter cloth, for example, in the form of an enclosure; however, this has the great disadvantage that an anode enclosure arranged in this manner can be easily damaged by means of sharp-edged anode material. Besides this, such damage is difficult to identify, so that a constant danger would be present of an uncontrolled exit of anode slurry.

In a practical manner, the perforated contact plate extends over the entire width of the anode case. The perforations, which in the case of rapid galvanization permits a sufficiently permanent exchange of fresh electrolyte in a practical manner, is limited to the regions of the contact plate which are not covered by the support bar arrangement.

In the case of a preferred embodiment of the invention, the free end of the perforated contact plate projects beyond the upper edge of the lower narrow or short side of the anode case and is bent toward the anode case into a loop-shaped channel which serves for the fixing of a screen.

DESCRIPTION OF THE PREFERRED EMBODIMENTS

Figure 1:
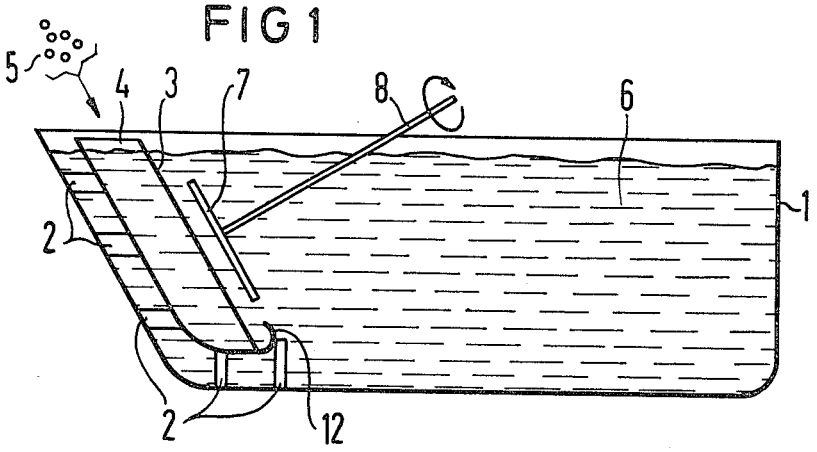
FIG. 1 illustrates by schematic representation a deposition cell in cross-section.
Figure 2:
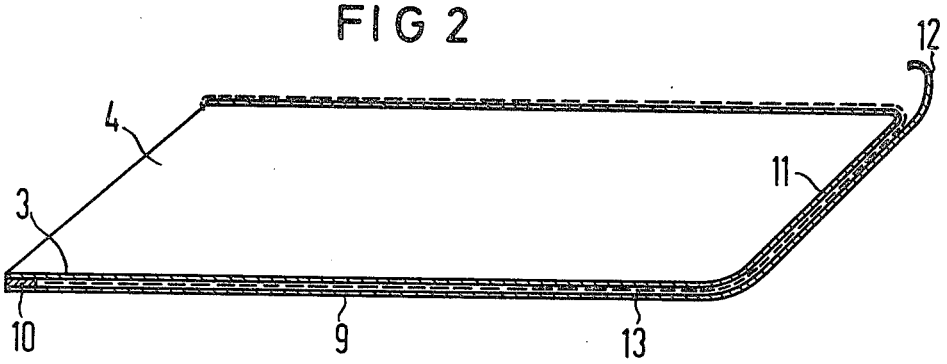
FIG. 2 illustrates an anode case of the invention in cross-section.

In FIG. 1, the deposition cell is designated 1. The left tank edge runs upwardly at a slant and has on the inner side a guide or support bar arrangement 2, on which the anode case 3 is supported. The anode case on the upper short side has a feed opening 4 for pellets 5 or other shaped anode material well-known in the art and is immersed in the electrolytes solution 6 which has a surface level almost up to the feed opening 4. The cathode, which is arranged at a slight spacing at the front side of the anode case 3, here consists of the workpiece which is to be galvanized in the form of a plate-shaped recording medium 7, which is fastened on the front end of a rod-shaped and rotatably arranged current supply line 8. The anode case 3, which is illustrated in FIG. 2 from the support side having the support or guide bar arrangement 2 according to FIG. 1, displays a contact plate 9 which, in the vicinity of the feed opening 4, is fastened to the anode case 3 by means of a welded joint 10. The contact plate 9, which has the width of the anode case, extends over the entire length of the anode case 3 including its front narrow side 11 and ends at its free projecting end 12 in a bend toward the anode case which forms a groove or channel. The free end 12 which is designed in this manner facilitates the fixing of a screen which is necessary for a uniform deposition and it simultaneously serves as a stop on the guide or supporting bar arrangement. The anode enclosure or bag 13 which envelopes the anode case 3 is drawn into the slot formed by the underside of the anode case and the contact plate 9.

Figure 3:
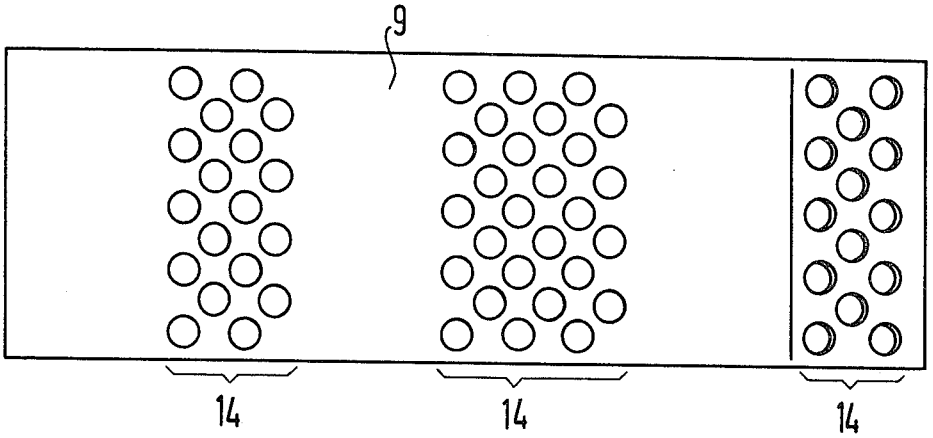
FIG. 3 illustrates a plan view of the contact plate for the anode case according to FIG. 2.

At the top view onto the contact plate 9 according to FIG. 3 shows, the contact plate has three groups of perforations 14, which are arranged and designed such that they provide as good as possible a rate of flow of fresh electrolyte through the anode case without influencing the equally desirable good electrically conducting transition between the guide or support bar arrangement and the contact plate, or respectively, the anode case.

The anode box consists of titanium expanded metal. The term expanded metal is here to be understood as a screen-shaped sheet metal. The contact plate likewise consists of titanium and is provided with holes as shown.

The anode sack is comprised of a plastic tissue which is transmissive to fluids, for example, nylon or polypropylene.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. An anode case for use within a deposition cell of a galvanic bath having a guide or support bar arrangement for supporting the anode case in good electrical conducting contact therewith, comprising: a feed opening at an upper end of the case through which deposition material is supplied; on the anode case at a side which rests on the guide bar arrangement a perforated contact plate being fastened in a good electrically conducting manner, said contact plate being positioned at a predetermined small spacing from a side of the anode case so as to form a slot along an entire length of the anode case and also along a lower end wall thereof at a bottom of the case; an anode bag which is not permeable to an anode slurry formed by dissolving anode material enveloping the anode case and having a portion located on the side of the contact plate in the slot formed between the contact plate and the anode case.

2. An anode case according to claim 1 wherein the perforated contact plate extends over an entire width of the anode case.

3. An anode case according to claim 1 wherein a free end of the perforated contact plate projects at the lower end of the casing towards an object being galvanized and is bent into a curved lip means for supporting a screen to be placed on a side of the anode case adjacent the object being galvanized.

4. An anode case according to claim 1 wherein the contact plate is fastened at its upper end to the anode case adjacent the feed opening thereof.

5. A galvanic bath system, comprising: container means for containing an electrolyte solution; on a side wall of the container metal support means being provided for receiving a conductive anode case in freely resting support thereon, the supporting arrangement being electrically conductive; said anode case being formed of an inner casing having apertures through which the electrolyte solution may flow, an anode bag partially surrounding the casing and comprising a material which is permeable to the electrolyte solution but impermeable to a slurry formed within the casing when pellets provided therein are at least partially dissolved by the electrolyte solution; and a contact plate means having apertures therein and which is positioned between a side wall of the anode case and the supporting arrangement, said contact plate means being attached to the anode case so as to provide a slot between the contact plate and anode case side wall into which the anode bag may be slid when enveloping the anode case with the anode bag, said contact plate means providing a low resistance contact between the anode case and the support means.

* * * * *